US006709298B2

(12) United States Patent
Bradley

(10) Patent No.: US 6,709,298 B2
(45) Date of Patent: Mar. 23, 2004

(54) INSULATOR CORING AND CONTACT CONFIGURATION TO PREVENT PIN STUBBING IN THE THROAT OF TUNING FORK SOCKET CONNECTOR CONTACTS

(75) Inventor: Robert M. Bradley, Oakville, CT (US)

(73) Assignee: Litton Systems, Inc., Los Angeles, CA (US)

( * ) Notice: Subject to any disclaimer, the term of this patent is extended or adjusted under 35 U.S.C. 154(b) by 0 days.

(21) Appl. No.: 10/114,471

(22) Filed: Apr. 3, 2002

(65) Prior Publication Data

US 2002/0146941 A1 Oct. 10, 2002

Related U.S. Application Data

(60) Provisional application No. 60/281,826, filed on Apr. 6, 2001.

(51) Int. Cl.[7] ..... H01R 13/502

(52) U.S. Cl. ..... 439/701; 439/374; 439/378; 439/79; 439/752.5; 439/608

(58) Field of Search ..... 439/701, 752.5, 439/378, 608, 79, 374

(56) References Cited

U.S. PATENT DOCUMENTS 5,066,236 A * 11/1991 Broeksteeg ..... 439/79
5,378,170 A * 1/1995 Abe et al. ..... 439/595
5,472,358 A 12/1995 Tan et al.
5,664,969 A * 9/1997 Peterson et al. ..... 439/746
5,716,232 A * 2/1998 Endo et al. ..... 439/595
5,795,191 A 8/1998 Preputnick et al.
6,165,028 A 12/2000 Yotsutani et al.
6,196,853 B1 * 3/2001 Harting et al. ..... 439/79
6,347,962 B1 * 2/2002 Kline ..... 439/608

FOREIGN PATENT DOCUMENTS

| | | |
|---|---|---|
| EP | 0 717 468 A | 6/1996 |
| EP | 0 924 806 A | 6/1999 |
| GB | 2 168 550 A | 6/1986 |
| KR | 10-2002-0002298 | 1/2002 |

* cited by examiner

*Primary Examiner*—Truc Nguyen
(74) *Attorney, Agent, or Firm*—Lowe Hauptman Gilman & Berner LLP

(57) ABSTRACT

A socket connector for a pin connector including a module body with a plurality of slots is described. A plurality of wafers are installable in a corresponding plurality of slots in the module body and each wafer has multiple offset tuning forks. The module body has a coring wall with multiple wedge shaped protrusions for each of the offset tuning forks of the wafer.

18 Claims, 8 Drawing Sheets

INSULATOR CORING AND CONTACT CONFIGURATION TO PREVENT PIN STUBBING IN THE THROAT OF TUNING FORK SOCKET CONNECTOR CONTACTS

RELATED APPLICATION

This application claims the benefit of U.S. Provisional Application Serial No. 60/281,826 filed Apr. 6, 2001.

TECHNICAL FIELD

The present invention relates generally to electrical connectors, and more particularly, to a pin and socket connector system which employs a tuning fork style socket contact.

BACKGROUND ART

Electrical contacts using a two-piece pin and socket connector system employing a tuning fork style socket contact have been used in the art. The difficulty with such a contact system is that the pin contact often tends to run into the base of the tuning fork shaped socket if the pin is not kept in proper alignment. In other words, if the pin is not properly aligned as the pin and tuning fork style socket contact are brought into full mating position, the pin contact, being an unsupported straight beam, will tend to crumple and become damaged. This causes the loss of a single pin contact and signal connection and will require the pin contact to be replaced. Accordingly, a need exists in the art for a pin and tuning fork style pin and socket connector system which prevents or eliminates the pin contact from being damaged when the pin is inserted into the mated position through the throat of the tuning fork style contact.

DISCLOSURE OF THE INVENTION

It is, therefore, an object of the present invention to provide a pin and tuning fork style pin and socket connector system in which the pin is guided or prevented from being damaged when brought into a mated position with the tuning fork style socket contact.

The present invention provides a socket connector for a pin including a module body with a plurality of slots. A plurality of wafers are installable in a corresponding plurality of slots wherein each wafer has multiple offset tuning forks. The module body has a coring wall with multiple wedge shaped protrusions for each of the offset tuning forks.

In another embodiment, the present invention provides a socket connector for a pin connector including a module body having a plurality of slots. A wafer block is installable in a corresponding plurality of slots wherein the wafer block has multiple offset tuning forks. The module body has a coring wall with multiple wedge shaped protrusions for receiving each of the offset tuning forks.

Still other objects and advantages of the present invention will become readily apparent to those skilled in the art from the following detailed description, wherein the preferred embodiments of the invention are shown and described, simply by way of illustration of the best mode contemplated of carrying out the invention. As will be realized, the invention is capable of other and different embodiments, and its several details are capable of modifications in various obvious respects, all without departing from the invention. Accordingly, the drawings and description thereof are to be regarded as illustrative in nature, and not as restrictive.

BRIEF DESCRIPTION OF THE DRAWINGS

The present invention is illustrated by way of example, and not by limitation, in the figures of the accompanying drawings, wherein element having the same reference numeral designations represent like elements throughout and wherein.

BEST MODE FOR CARRYING OUT THE INVENTION

Figure 1:
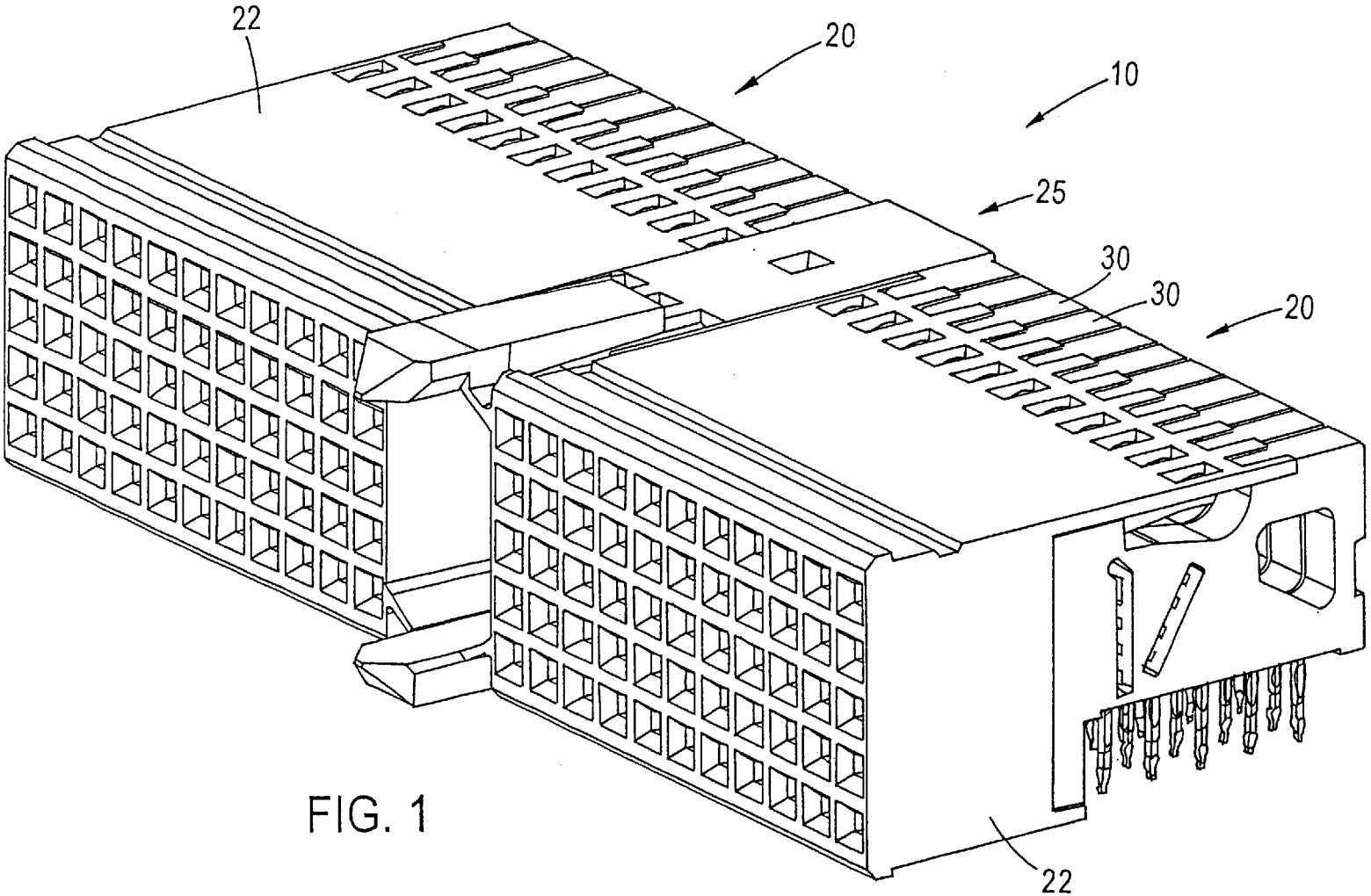
FIG. 1 is a perspective illustration of a fully assembled socket side connector.

Reference is now made to FIG. 1 wherein a socket side connector assembly 10 is depicted. The socket side connector assembly 10 includes two socket connector housing assemblies 20, each including an insulator module 22, which are connected together by a connector 25. Each of the insulator modules 22 receives a plurality of wafers 30 which are fixed in place in the insulator modules 22, as described below. The socket connectors depicted in FIG. 1 are from the Winchester Electronics 2 mm product line, but the principles of the present invention are applicable to any two-piece pin and socket connector system employing a tuning fork style socket contact.

As depicted in FIG. 1, each insulator module 22 accepts eleven wafers 30. Each wafer in turn includes five tuning fork style contacts and five right angle pin contacts and therefore each assembly 20 forms an 11×5 matrix which includes 55 signal contacts. It is to be understood that any number of signal contacts could be used in the present invention. Additionally, any number of modules 22 can be used. Further, the present invention is illustrated as a right angle connector but the principles of the present invention can be used with any type of tuning fork contact.

Further still, even though the connector assembly 10 is depicted and described as comprising multiple wafers 30 inserted into insulator module 22, it is to be understood that multiple wafers can be replaced by a single larger wafer, i.e., a wafer block, having the appropriate number of tuning fork style contacts and pin contacts.

Figure 2:
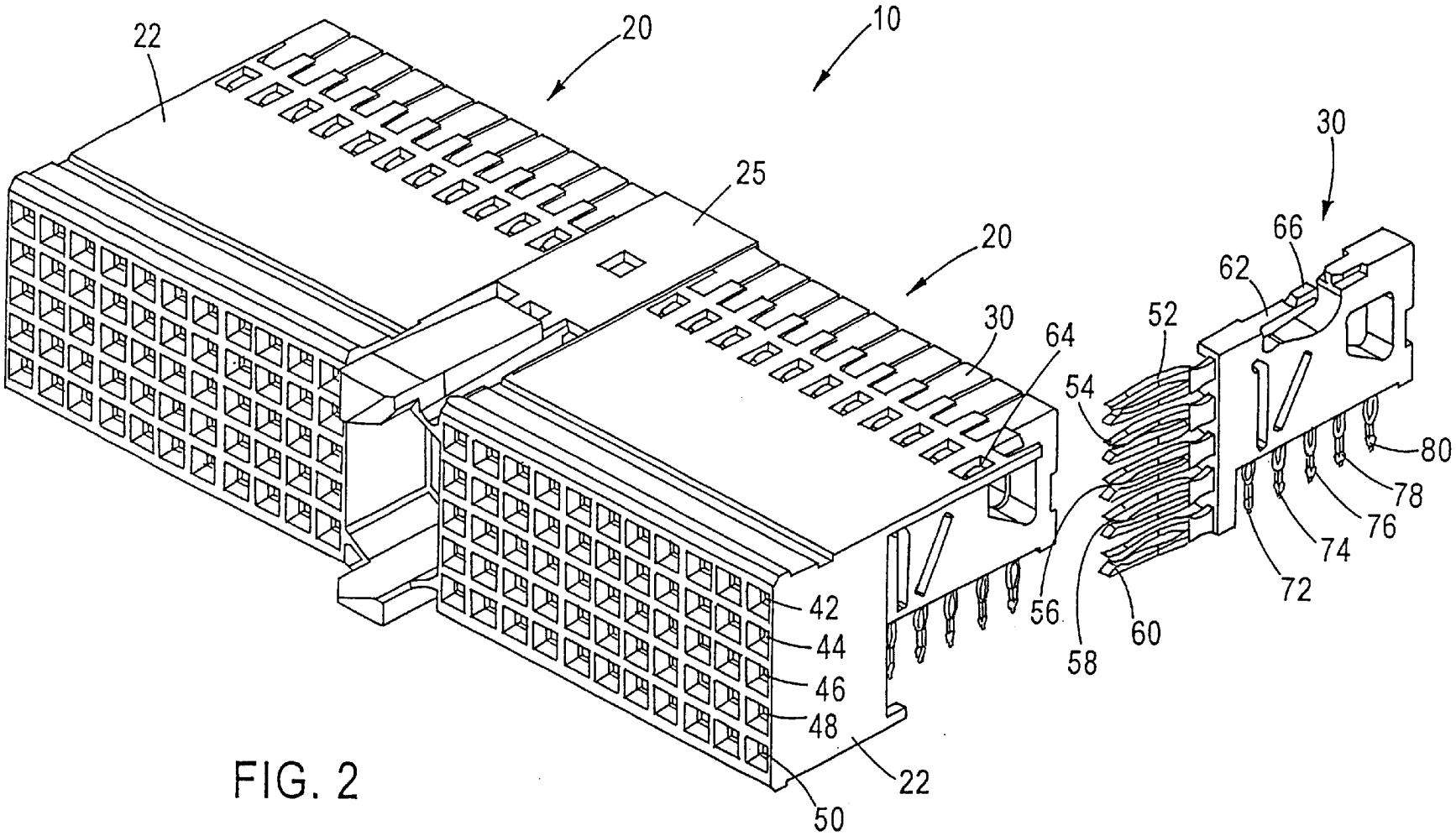
FIG. 2 is an exploded view, similar to FIG. 1, with one wafer not installed.

As depicted in FIG. 2, each wafer assembly 30 is inserted into the insulator module 22. The insulator module 22 has a plurality of contact windows 42, 44, 46, 48, 50 in which a corresponding pin is inserted to be received in a corresponding fork style socket contact 52, 54, 56, 58, 60.

To secure each wafer 30, each of the wafers has a flexible beam type retention mechanism 62 which has a retention member 66 which snaps into a corresponding hole 64 in the insulator module 22.

Figure 3:
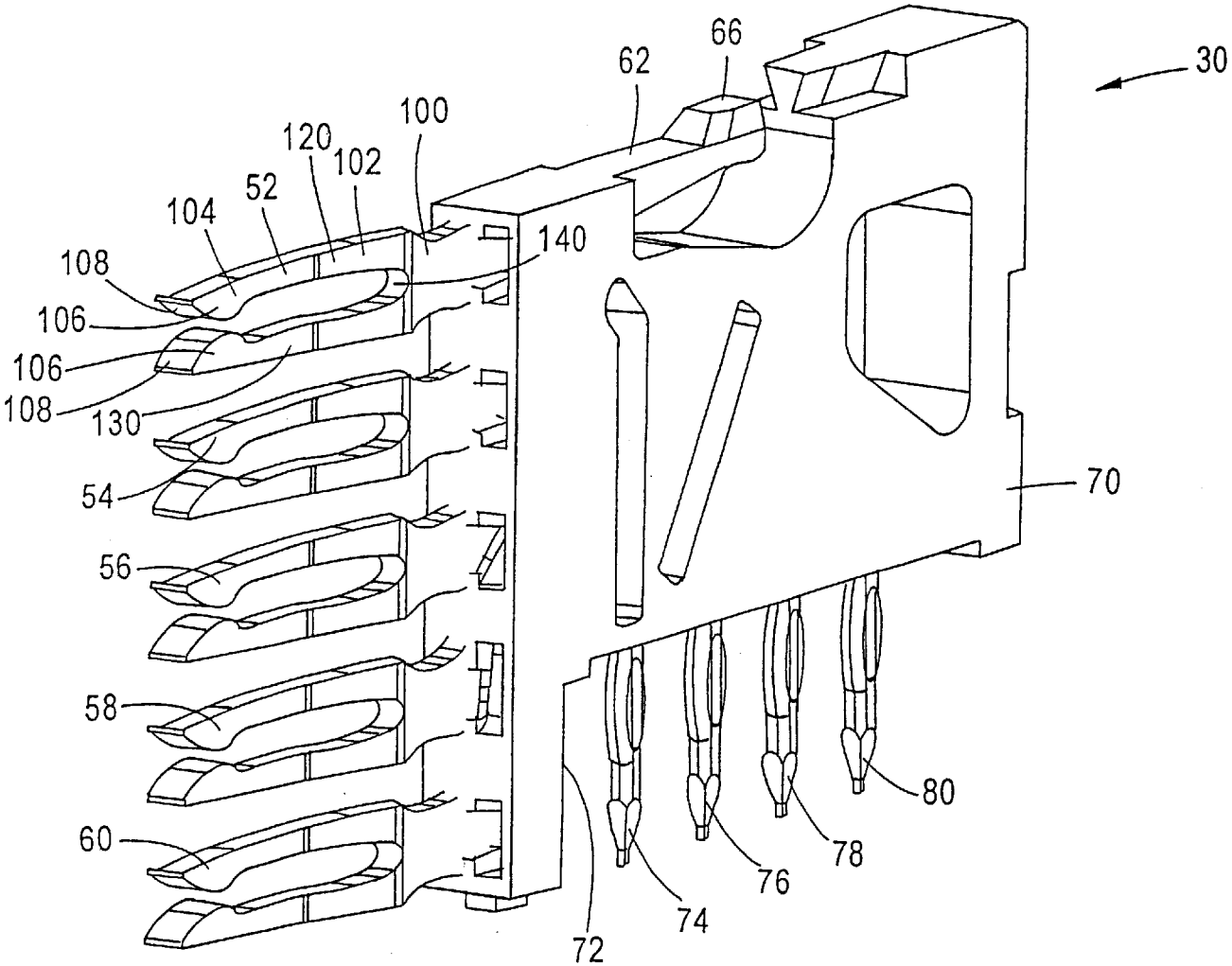
FIG. 3 is a perspective view of a wafer with five tuning fork contacts molded into the wafer body.

Reference is now made to FIG. 3 depicting an enlarged perspective view of the wafer 30 of FIGS. 1 and 2. Each wafer 30 has an insulated body portion 70. Each fork style socket contact has a straight portion 100, an offset portion 102, and a mating portion 104. The mating portion 104 includes opposed mating v-ramps 106 each having a front ramp 108 to facilitate insertion of the pin into the tuning fork style contact 52, for example. Each tuning fork style contact has a throat defined by the opposing beams 120 and 130 as depicted in FIG. 3. Beams 120 and 130 are joined at a base of the throat section 140.

Each of the tuning fork style contacts 52–60 is electrically connected through housing 70 to a corresponding pin connector 72–80 in a conventional manner.

Figure 4:
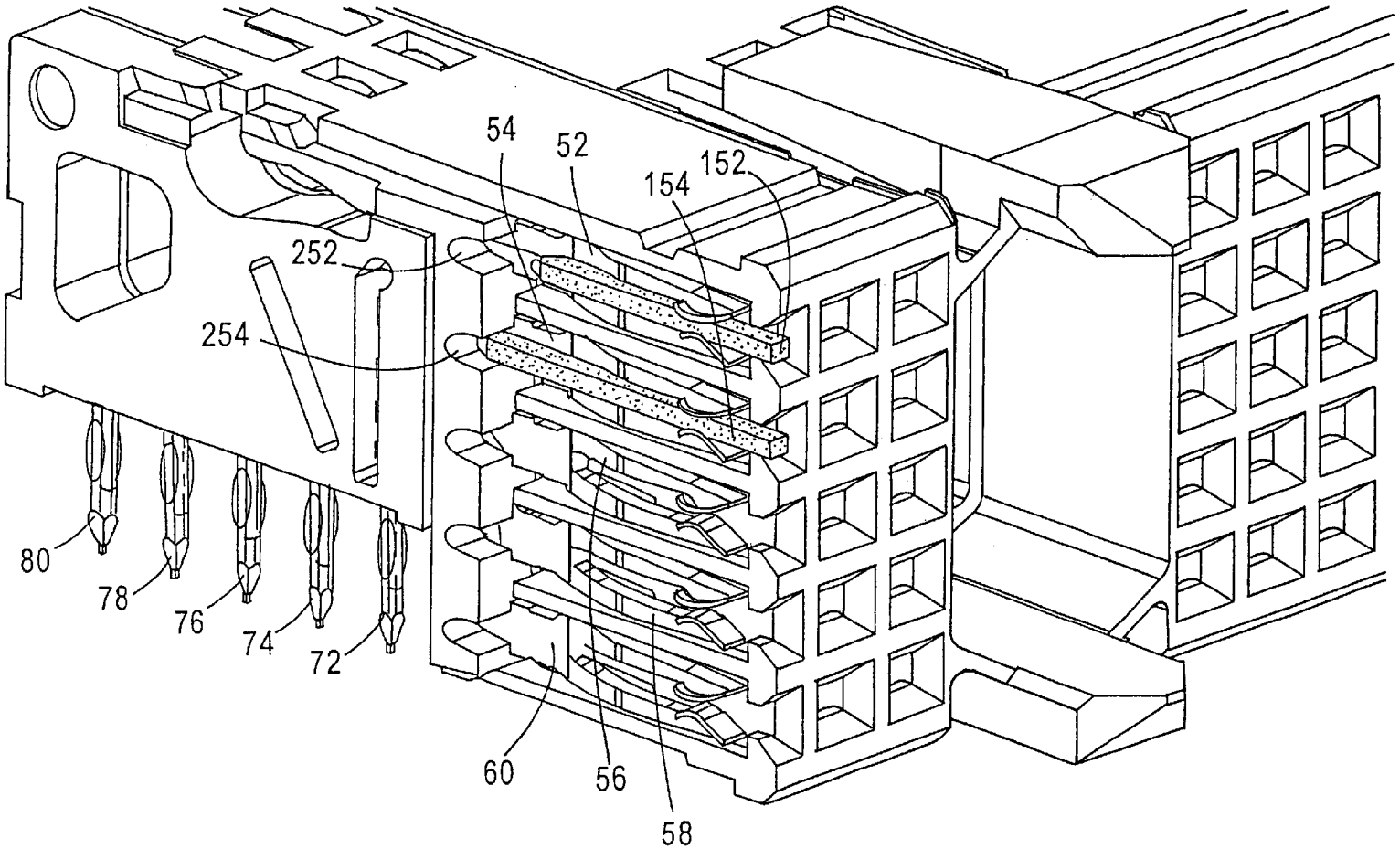
FIG. 4 is a cross-section through the module with a wafer shown in a fully installed position and two pin contacts having different lengths.

As depicted in FIG. 4, pin contacts 152, 154 are shown in the mated position. It should be noted that the pin contacts 152, 154 pass beyond the base of the throat 140 of the socket contacts. As depicted in FIG. 4, the two pin contacts 152, 154 have different lengths. Pin contact 154 extends into a receiving portion 254 formed in the wafer 30 and which is positioned and aligned with openings 42–50 for example. As depicted in FIG. 4, pin 154 is a sufficient length to be received by receiving portion 254, whereas pin 152 is shorter and is not received by receiving portion 252.

Figure 5:
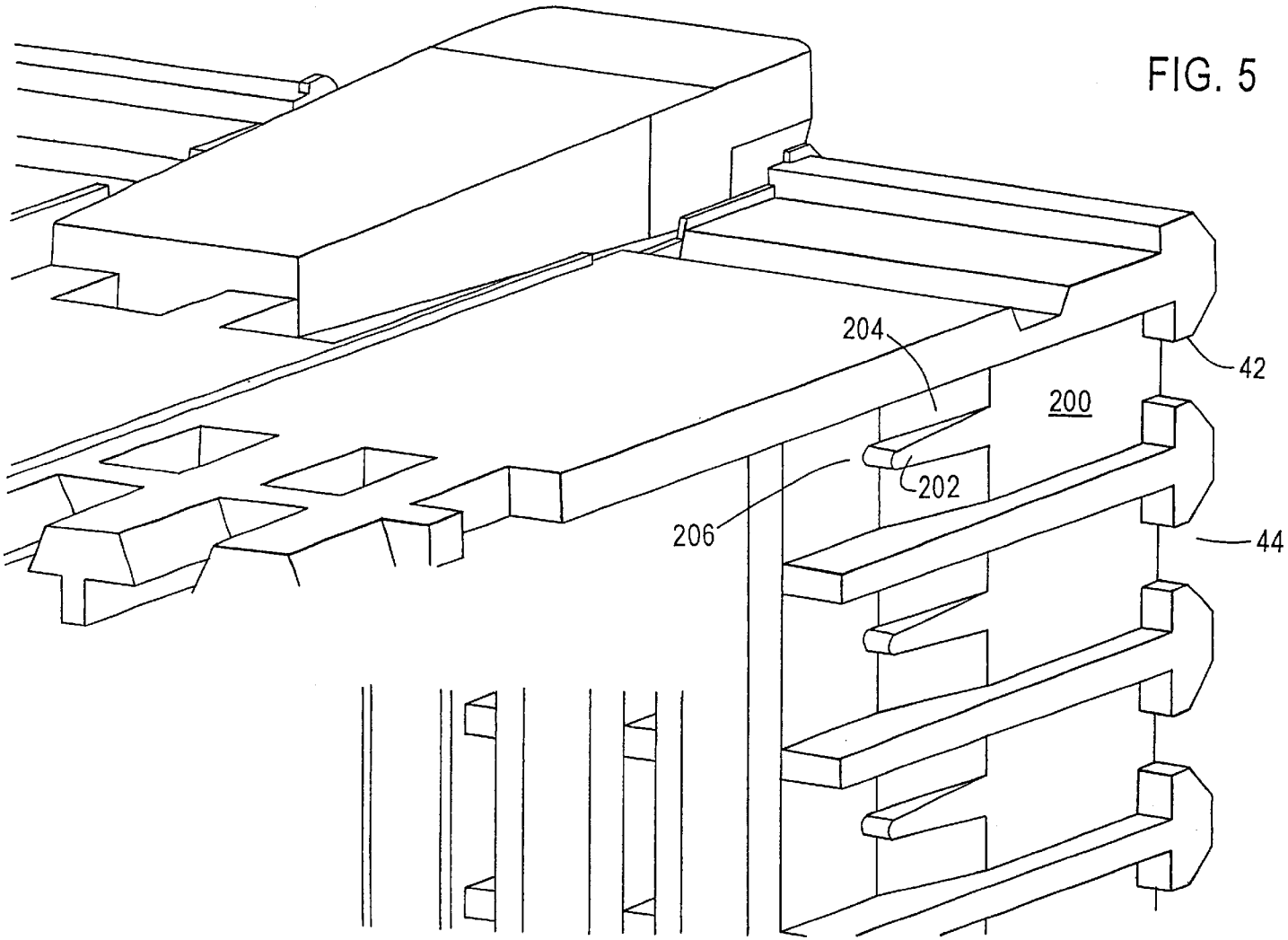
FIG. 5 is a rear perspective view, in cross-section, of the module showing the coring wall wedge shaped protrusion.

The configuration of the coring wall 200 which receives the tuning fork style contact is depicted in FIG. 5. The coring wall 200 includes a central wedge shape portion 202 and an offset wall 204 and a straight wall 206. Advantageously, the wedge shape protrusion 202 extends nearly to the base of the contact throat 140 when the wafer 30 is installed in the module 30 such that the pins 152, 154 when inserted through the tuning fork style contact are prevented from stubbing into the base of the throat 140 of the socket contact 52, 54.

Figure 6:
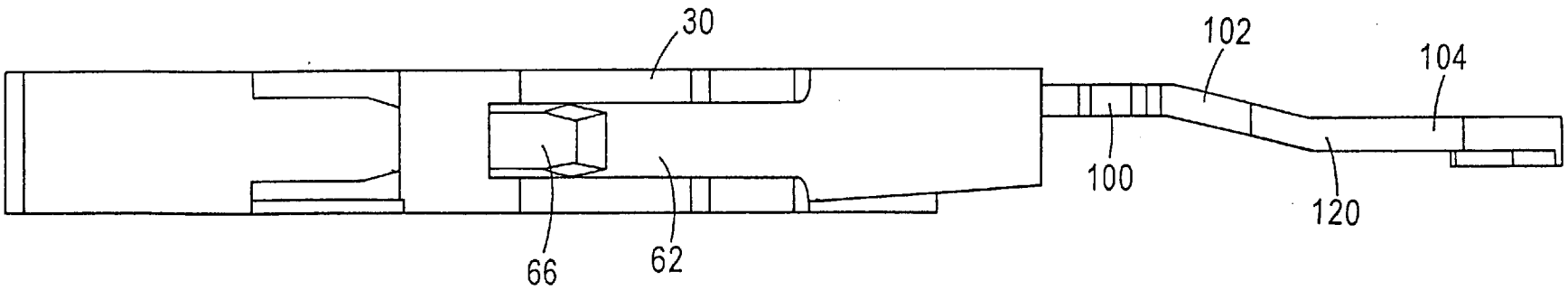
FIG. 6 is a top plan view of a single wafer showing the offset of the tuning fork beam.

FIG. 6 is a top view of the wafer 30 depicting the offset of the tuning fork beams 120, 130. As depicted in FIG. 5, wedge shaped protrusion 202 of wall 204 conforms to the offset portion 102 of the tuning beams 120, 130 such that the wedge shaped protrusion 202 fits closely or nearly to the base of the throat 140 so that the pins 152, 154 when inserted as depicted in FIG. 6, even if the pins 152, 154 bend slightly towards the base of the contact throat 140, are prevented from entering the contact throat and thereby becoming deformed.

Figure 7:
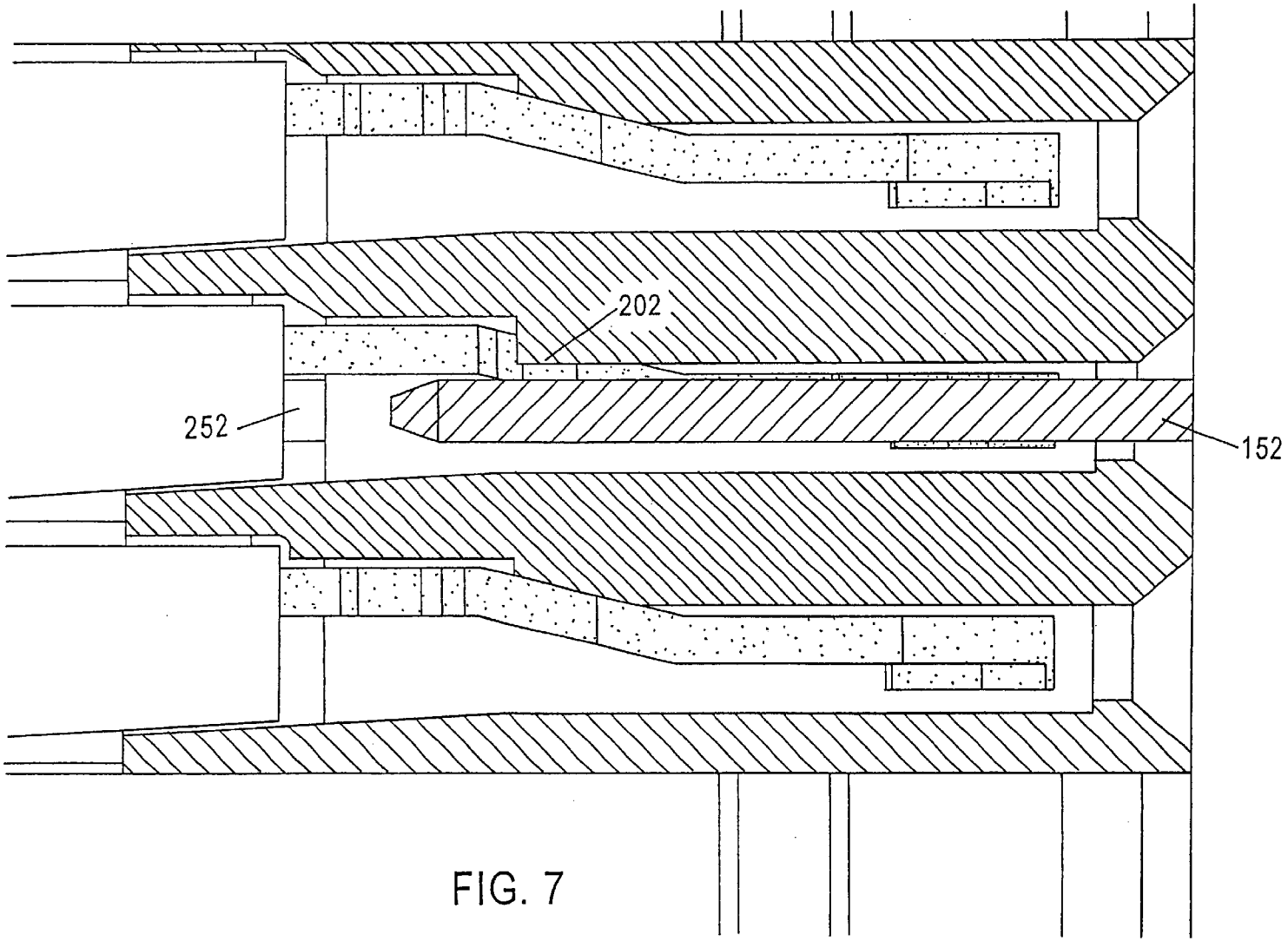
FIG. 7 is a schematic representation of a sectional view through a wafer installed in the module illustrating how the combination of the offset and the contact beams and the wedge shaped protrusion in the coring wall provide a means to prevent the pin contact from stubbing into the base of the throat of the socket contact.

FIG. 7 is a view through a section of the wafer 30 installed in the insulator module 22 that depicts how the combination of the offset and the contact beams 120, 130 and the wedge shaped protrusion 202 and the coring wall 200 provide a mechanism to prevent the pin contact 152 from stubbing into the base of the throat 140 of the socket contact 52.

Figure 8:
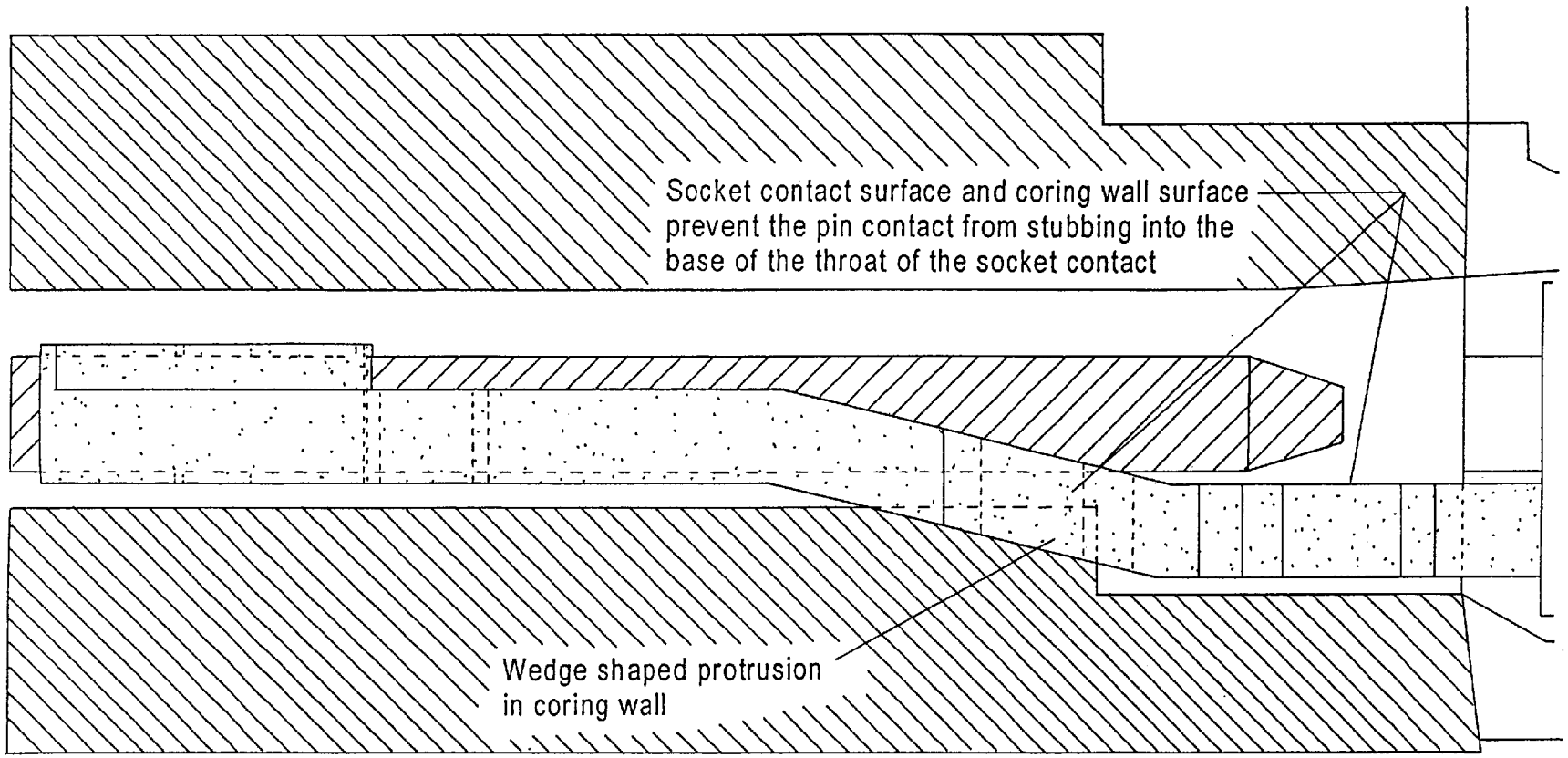
FIG. 8 is a schematic cross-sectional view through a module, wafer and pin contact illustrating the relationship between the surfaces of the socket contact base area, the wedge shape protrusion of the coring wall and the tip of the mating pin contact.

FIG. 8 is another section through the insulator module 22, wafer 30 and pin contact 52 depicting the relationship between the surfaces of the socket contact base area 140, the wedge shaped protrusion 202 of the coring wall 200 and the tip of the mating pin contact 152. These relationships contribute to prevent the pin contact from stubbing into the base of the throat 140 of the socket contact 52.

It will be readily seen by one of ordinary skill in the art that the present invention fulfills all of the objects set forth above. After reading the foregoing specification, one of ordinary skill will be able to affect various changes, substitutions of equivalents and various other aspects of the invention as broadly disclosed herein. It is therefore intended that the protection granted hereon be limited only by the definition contained in the appended claims and equivalents thereof.

What is claimed is:

1. A socket connector for a pin connector, comprising:

a module body including a plurality of slots;

a plurality of wafers each installable in a corresponding one of said plurality of slots, each wafer having multiple offset tuning fork, wherein said tuning forks comprise two beams joined at a base;

said module body having a coring wall having multiple wedge shaped protusions for each of said offset tuning fork, wherein said protrusions extend adjacent to the base of the tuning fork and align with a pin receiving opening of said module body thereby allowing a distal end of a pin of the pin connector to be guided by the protrusions and pass beyond the base without interfering with the base.

2. The socket connector of claim 1, wherein said wafer includes a multiple pin receiving portion for receiving a distal end of a corresponding pin.

3. The socket connector of claim 1, wherein said module body includes an opening corresponding to each slot and said wafer includes a retention member fitted to said opening of said module body.

4. The socket connector of claim 3, wherein said retention member is a flexible beam retention mechanism.

5. The socket connector of claim 1, wherein said offset tuning forks comprise two beams joined at a base of a throat section of said tuning forks.

6. The socket connector of claim 5, wherein said wedge shaped protrusion extends nearly to the base of said offset tuning forks.

7. The socket connector of claim 5, wherein said beams have opposed mating v-ramp ends.

8. The socket connector of claim 6, wherein said wafer includes a multiple pin receiving portion for receiving a distal end of a corresponding pin.

9. The socket connector of claim 8, wherein said distal end is extendable beyond said base of said offset tuning forks.

10. A socket connector for a pin connector, comprising;

a module body including a plurality of slots, wherein said module body has a coring wall having multiple wedge shape protrusions;

a wafer block installable in multiple corresponding plurality of slots, each wafer block having multiple offset tuning fork wherein said tuning forks comprising two beams joined at a base, wherein said tuning forks interact with said protrusion, wherein said protrusions extend adjacent to the base of the tuning fork and align with a pin receiving opening of said module body thereby allowing a distal end of a pin of the pin connector to be guided by the protrusions and pass beyond the base without interfering with the base.

11. The socket connector of claim 10, wherein said wafer block includes a multiple pin receiving portion for receiving a distal end of a corresponding pin.

12. The socket connector of claim 10, wherein said module body includes an opening corresponding to each slot and said wafer includes a retention member fitted to said opening of said module body.

13. The socket connector of claim 12, wherein said retention member is a flexible beam retention mechanism.

14. The socket connector of claim 10, wherein said offset tuning forks comprise two beams joined at a base of a throat section of said tuning forks.

15. The socket connector of claim 14, wherein said wedge shaped protrusion extends nearly to the base of said offset tuning forks.

16. The socket connector of claim 14, wherein said beams have opposed mating v-ramp ends.

17. The socket connector of claim 15, wherein said wafer includes a multiple pin receiving portion for receiving a distal end of a corresponding pin.

18. The socket connector of claim 17, wherein said distal end is extendable beyond said base of said offset tuning forks.

* * * * *